US005453040A

United States Patent [19]

Schaal et al.

[11] Patent Number: 5,453,040

[45] Date of Patent: Sep. 26, 1995

[54] ECCENTRIC GRINDING MACHINE

[75] Inventors: Gunter Schaal, Stuttgart; Fred Weinmann, Filderstadt; Gunther Berger, Notzingen; Dieter Dorr, Filderstadt; Karl-Heinz Braunbach, Hornbach, all of Germany

[73] Assignee: Robert Bosch GmbH, Stuttgart, Germany

[21] Appl. No.: 885,171

[22] Filed: May 18, 1992

Related U.S. Application Data

[63] Continuation of Ser. No. 566,378, Aug. 28, 1990, Pat. No. 5,170,588.

[30] Foreign Application Priority Data

Mar. 24, 1988 [DE] Germany ..... 38 09 930.6

[51] Int. Cl.[6] ..... B24B 23/00

[52] U.S. Cl. ..... 451/344; 451/357

[58] Field of Search ..... 451/344, 357, 451/356, 359

[56] References Cited

U.S. PATENT DOCUMENTS

| | | | |
|---|---|---|---|
| 4,467,565 | 8/1984 | Wallace et al. | 51/170 MT |
| 4,727,682 | 3/1988 | Stabler et al. | 51/170 MT |
| 4,759,152 | 7/1988 | Berger et al. | 51/170 MT |

FOREIGN PATENT DOCUMENTS

| | | | |
|---|---|---|---|
| 0254850 | 2/1988 | European Pat. Off. | 51/170 MT |

*Primary Examiner*—Maurina T. Rachuba
*Attorney, Agent, or Firm*—Michael J. Striker

[57] ABSTRACT

The eccentric grinder includes a housing, a fan wheel mounted rotatably in the housing and being rotatably driven in the housing during operation, an eccentric shaft mounted rotatably and eccentrically in the fan wheel, a grinding disk nonrotatably fixed in a central portion thereof with the eccentric shaft and an outer region of the grinding disk being arranged without connection to a remaining group of parts of the grinder and axially spaced therefrom; and at least one exchangeable reversible intermediate plate. Each of the intermediate plates can be mounted nonrotatably on the eccentric shaft between the grinding disk and the housing during operation in one of two positions. To cause a rotary motion of the grinding disk in addition to an eccentric motion one of the intermediate plates is provided with only one toothed or friction rim which is engaged in a fixed toothed or friction rim provided on the housing when the intermediate plate is installed in one of the two positions during operation. Since the other side of that intermediate disk does not have a toothed or friction rim, when the intermediate disk is installed in the other, turned-over position in operation a fine grinding motion results without a rotary motion around the eccentric shaft.

12 Claims, 3 Drawing Sheets

FIG. 2
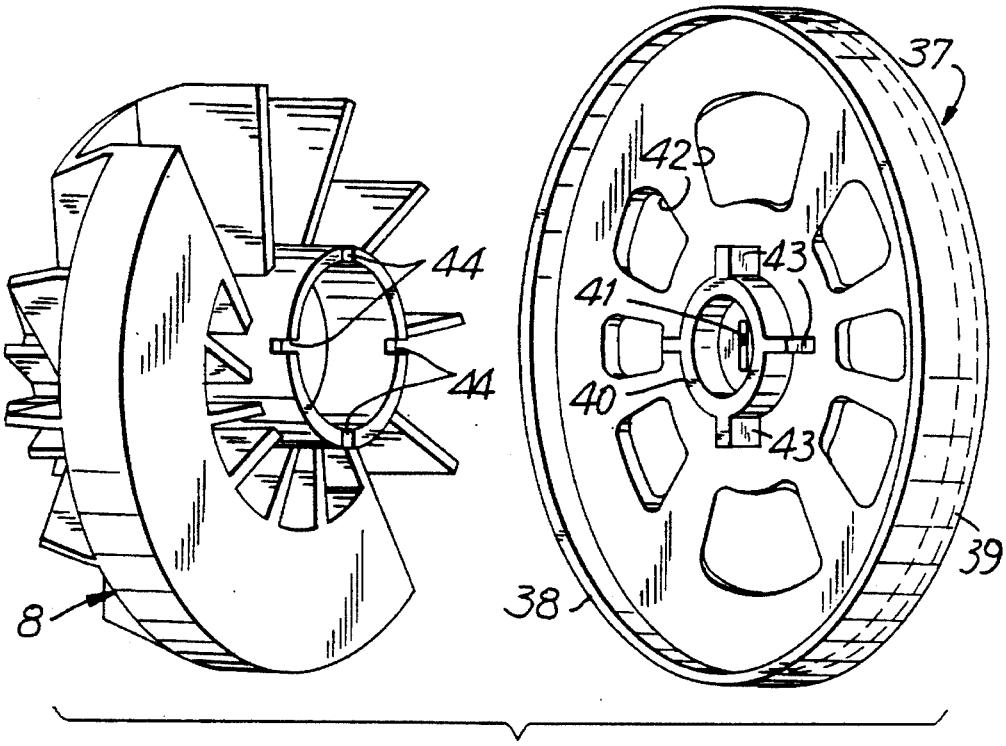
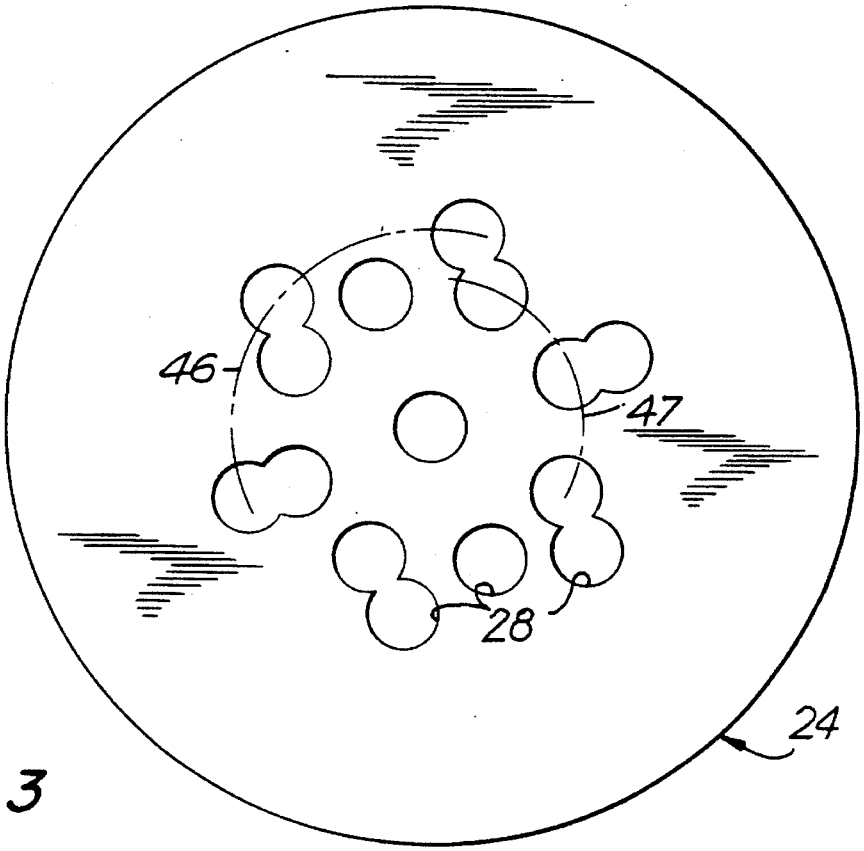
FIG. 3

ECCENTRIC GRINDING MACHINE

This is a continuation of application Ser. No. 566,378 filed Aug. 28, 1990 now U.S. Pat. No. 5,170,588.

BACKGROUND OF THE INVENTION

The invention is based on an eccentric grinder or grinding machine.

An eccentric grinder is known having an eccentric shaft and a grinding disk attached nonrotatably to the eccentric shaft as well as a device for changing the grinding movement of its grinding disk with at least one fixed toothed rim. In this eccentric grinder an outer region of the grinding disk is arranged without connection to the rest of the parts of the grinder and is spaced axially from the latter and the grinding disk is attached to the eccentric disk in a central portion thereof.

In such a grinder, as is described in DE-OS 36 09 441, the toothed rims of the eccentric gear unit are fastened partly to a toothed ring and partly directly to the grinding disk. As a result, a pressure exerted on the grinding disk edge during work leads to twisting of the toothed rim arranged on the grinding disk due to the elasticity of the latter and accordingly leads to meshing difficulties in the eccentric gear unit. Moreover, the gear unit comprising six toothed rims is relatively costly.

SUMMARY OF THE INVENTION

It is an object of the present invention to provide an eccentric grinding machine, in which the above-mentioned difficulties are eliminated.

This object, and others which will be made more apparent hereinafter, is attained in an eccentric grinding machine comprising a housing, an eccentric shaft, a grinding disk and a device for changing a grinding movement of the grinding disk having at least one fixed friction or toothed rim in a fixed relationship with the housing, the grinding disk being nonrotatably fixed in a central portion thereof with the eccentric shaft and an outer region of the grinding disk being arranged without connection to a remaining group of parts of the grinder and spaced axially therefrom.

According to the invention at least one exchangeable, reversible intermediate plate is provided for the grinder. Each of the intermediate plates is provided with at least one other friction or toothed rim. In operation, one of the intermediate plates is mounted on the eccentric shaft and one of the other friction or toothed rims of that intermediate plate is engagable with the fixed friction or toothed rim having the fixed relationship with the housing to cause a rotary motion of the grinding disk in addition to an eccentric motion.

In contrast, the eccentric grinder, according to the invention, has the advantage that the grinding disk has no gear unit parts and is connected only in its central part with the next structural component part so as to be fixed with respect to rotation relative to it. This enables the use of elastic plastic for the grinding disk, without deformations of the disk being propagated into the gear unit. Moreover, the cost of the gear unit is reduced because two of the toothed rims of the prior art can be dispensed with.

It is particularly advantageous that the intermediate plates extend up to the eccentric shaft and accordingly have a heat conducting connection. The heat occurring in the bearings of the eccentric shaft can accordingly be conducted into the intermediate plate and can be conveyed from the latter to the air flow entering through the ventilation openings. Moreover, the ventilation openings facilitate the manual removal of the intermediate plate.

The use of four differently constructed intermediate plates or two intermediate plates with two different sides, respectively, is also advantageous. This enables a total of four grinding movements of the eccentric grinder of different degrees of coarseness.

In one embodiment the eccentric grinder has a rotatable fan wheel mounted in the housing and the eccentric shaft is mounted rotatably and eccentrically in the rotatable fan wheel. An intermediate plate can be provided with radially extending connecting pieces on one side which engage in recesses in the rotatable fan so that when the intermediate plate is positioned in the grinder so that the connecting pieces engage in the recesses a coarse grinding motion largely due to rotation of the fan wheel is provided. On the other hand, if there is no other toothed or friction rim on the other side of the intermediate plate or if the toothed or friction rim on the other side does not mesh with the fixed toothed or friction rim on the housing when the intermediate plate is reversed so that the connecting pieces do not mesh with the recesses a fine grinding motion due to the eccentric motion only is provided.

Since the toothed rims connected with the housing are constructed from plastic and the toothed rims of the intermediate plate are constructed of wear-resistant metal, or vice verse, wear occurs on one side of the plastic toothing, which can be easily exchanged.

When the grinding disk is provided with fourteen properly spaced ventilation openings, commercially available six-hole grinding papers as well as those with eight holes can be used.

BRIEF DESCRIPTION OF THE DRAWING

The objects, features and advantages of the present invention will now be illustrated in more detail by the following detailed description, reference being made to the accompanying drawing in which:

FIG. 2 is a perspective view of a fan wheel with an intermediate plate for the grinder of FIG. 1;

FIG. 3 is a plan view of a grinding disk for the grinder of FIG. 1 showing ventilation openings.

DESCRIPTION OF THE PREFERRED EMBODIMENTS

Figure 1:
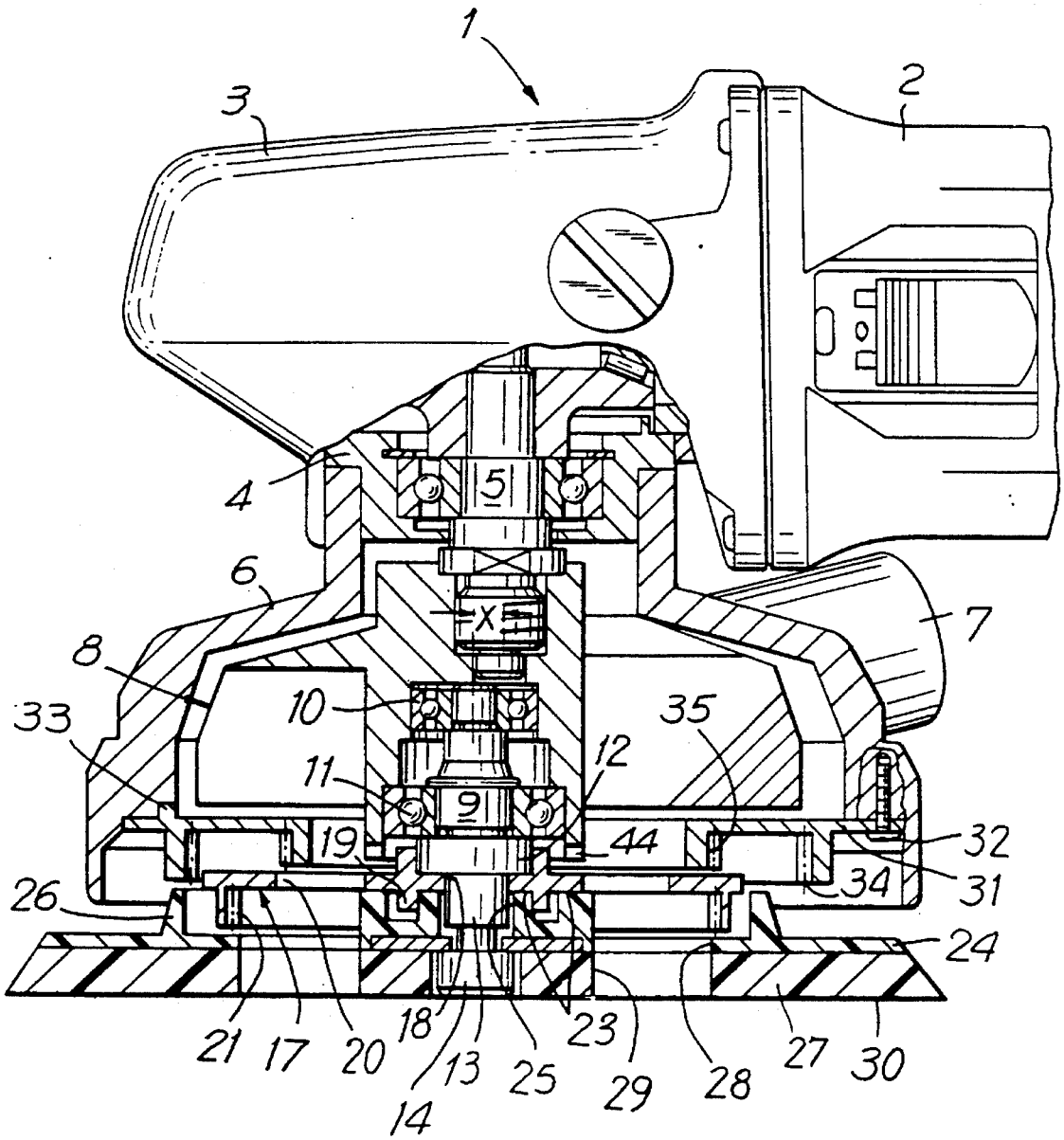
FIG. 1 is a partially cross-sectional, partially side elevational, view of a grinder according to the invention.

An eccentric grinder 1 has a motor housing 2 and a grip stock 3 which is arranged above a gear unit housing 4 for an angular gear unit with power take-off shaft 5. A fan housing 6 which is provided with an exhaust connection piece 7 is fastened to the housing 4. A fan wheel 8 which is securely connected with the power take-off shaft 5 is located in the fan housing 6. An eccentric shaft 9 with eccentricity X relative to the axis of the drive shaft 5 is inserted in the fan wheel 8 from below and supported by the bearings 10 and 11. The eccentric shaft 9 has a collar 12 and a rectangular end portion 13 with an internal thread for a fastening screw 14.

Figure 4:
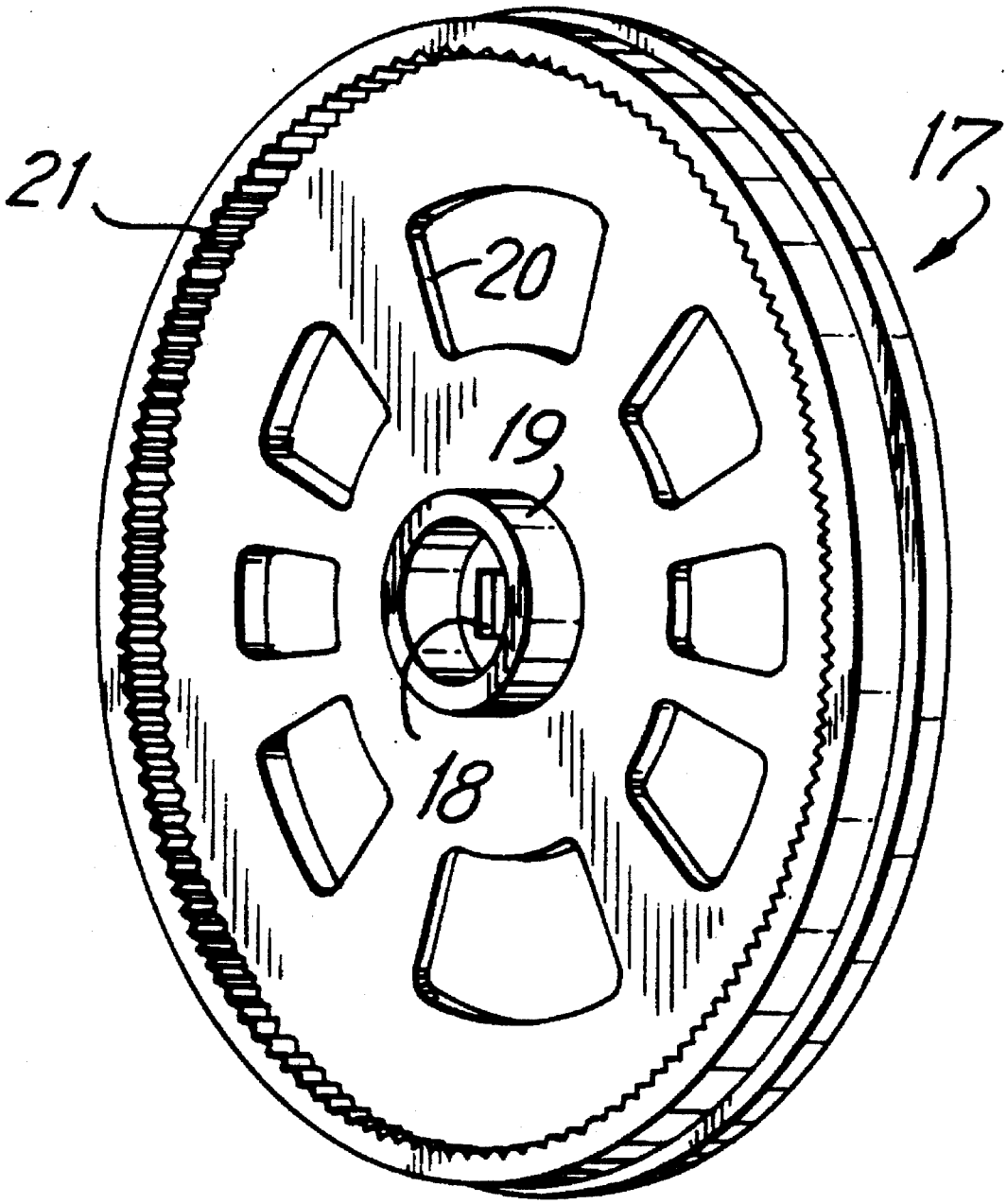
FIG. 4 is a perspective view of the intermediate plate of FIG. 1 having only one toothed rim in the preferred embodiment of the invention.

An intermediate plate 17 shown in FIG. 4 with a rectangular central opening 18 is attached to the collar 12. The intermediate plate 17 preferably consists of aluminum which is provided with a hard, wear-resistant surface by anodization. The intermediate plate 17 has a raised ring 19 at both sides, which raised ring 19 rests against the collar 12 of the eccentric shaft 9 for the purpose of centering. The intermediate plate 17 has ventilation openings 20 radially outside the ring 19. The intermediate plate 17 carries, on one side at the outer edge, a friction or toothed rim 21. The toothed rim 21 can be constructed of aluminum, the basic work material of the intermediate plate 17, or plastic. A grinding disk 24 contacts the intermediate plate 17 with its raised central area 23. It is likewise attached to the end portion 13 with its central rectangular opening 25. The grinding disk 24 carries a collar 26 which projects forward so as to face the intermediate plate 17. An elastic support 27 is placed on the grinding disk 24. The grinding disk 24 and the support 27 have ventilation openings 28, 29. The ventilation openings 20 and 28 and 29 are arranged in such a way that they lie over one another so as to be aligned when the intermediate plate 17 and the grinding disk 2' are placed on the rectangular end portion 13. A grinding paper 30 is fastened to the support 27, e.g. by a loop-and-hook locking arrangement.

A toothed plate 31 is fastened to the stationary fan housing 6 by three screws 32. The toothed plate 31 has pins 33 which engage in corresponding recesses in the fan housing 5 for the purpose of securing against rotation and for centering. The toothed plate can also fastened to the fan housing 6 by snap connections instead of screws 32. The toothed plate 31 has two fixed friction or toothed rims 34, 35 of different diameters on the side facing the intermediate plate 17. One of these fixed friction or toothed rims 34, 35 can be made to be engagable with the toothed rim 21 on the intermediate plate 17 depending on which side of the reversible intermediate plate 17 faces the fixed friction or toothed rims 34, 35. The toothed rims 34, 35 are constructed either from plastic or a wear-resistant metal, so that there is a metal-to-plastic pairing with the toothed rim 21, in which wear can occur only at the plastic toothing which is easily exchangeable. Friction rims, e.g. with a rubber layer, can also be used instead of toothed rims 21, 34, 35.

FIG. 2 shows a second intermediate plate 37 which has rims 38, 39 on the circumference which correspond to the toothed rims 34, 35 on the intermediate plate 17, but which are toothless. In the central area, the intermediate plate 37 has a raised ring 40 at both sides and a central rectangular opening 41 just like the intermediate plate 17. The ventilation openings 42 correspond to the openings 20. The intermediate plate 37 has connecting pieces 43 on one of its two sides, which connecting pieces 42 extend radially outward from the ring 40 and can be inserted into recesses 44 in the fan wheel 8 in a positive-locking manner. A connection is accordingly formed between the fan wheel 8 and the intermediate plate 37 such that they are fixed with respect to rotation relative to one another. There are no connecting pieces on the rear side, not shown, so that the intermediate plate 37, when facing the fan wheel 8 with the rear side, can rotate freely without contacting it, as is also the case with the intermediate plate 17 (see FIG. 1).

FIG. 3 shows the arrangement of the ventilation openings 28 in the grinding disk 24. Six of the openings are arranged symmetrically with respect to a circle on a diameter 40 of approximately 80 mm and approximately eight openings 47 on a diameter of approximately 65 mm.

To produce different coarse grinding motions the intermediate plates 17, 37 can be exchangeable. To do this the fastening screw 14 is removed from the eccentric shaft 9 and the grinding disk 24 is removed with the intermediate plate. The removed intermediate plate can now be turned over and put back on the eccentric shaft 9 or replaced by another. The new or reversed intermediate plate is put on the end portion 13. Then the grinding disk 24, if necessary with different grinding paper on it, is put on the end portion 13 and the screw 14 is screwed back in place. The comparatively flat intermediate plate only a few millimeters thick is held easily on the eccentric shaft 9 by the grinding disk 24 and the fastening screw.

The basic operational principles of the drive of the eccentric grinder has already been described in DE-OS 36 09 441. As in the latter, two grinding movements of different degrees of coarseness are possible with i.e. intermediate plate 17. When the toothed rim 21 does not engage in the toothed rim 35, a fine grinding movement results with only on eccentric movement. When the toothed rim 21 engages in the toothed rim 35, a coarse grinding movement is produced in which the rotational movement of the grinding disk is in the same direction as the eccentric movement.

Two different grinding movements can likewise be produced with the intermediate plate 37, a fine grinding movement, when the intermediate plate can rotate freely, and a very coarse grinding movement, when the connector pieces 43 engage with the recesses 44 of the fan wheel.

When pressure is exerted on the edge of the grinding disk 24 during the grinding process, the latter bonds inward toward the fan housing 6. This is made possible because of a gap of approximately 1–2 mm between the inside of the grinding disk 24 and the respective rim 21, 22, 38, 39 facing the grinding disk. On the other hand, an excessive bending of the grinding disk is prevented when the grinding disk abuts at the rim 21, 22, 38, 39.

The fan wheel 8 fulfills a number of functions. In addition to producing the eccentric movement and compensating for imbalances, it produces a suction air current which simultaneously serves to cool the bearings and the gear unit. Air which is charged with grinding dust is sucked through the ventilation openings 29 and 28 in the grinding disk as well as 20 in the intermediate plate and discharged again via the exhaust air connection piece 7. The intermediate plate 17 and 37, respectively, at which the heat occurring in the bearings 10 and 11 is dissipated via the eccentric shaft 12, is simultaneously cooled by the air flow.

The intake of secondary air through the gap between the grinding disk 24 and the fan housing 6 is extensively prevented by 26 of the labyrinth effect of the cellar 26 at the grinding disk and the rim 21, 22, 38, 39 of the intermediate plate 17, 37, which rim 21, 22, 38, 39 faces the grinding disk.

The invention is not limited to the shown embodiment example. Instead of the two reversable intermediate plates 17 and 37, four individual plates can also be used, each of which can be securely connected with a single grinding disk in the central area. This would also result in a flatter construction of the grinder.

However, the four grinding movements can also be produced by a single intermediate plate which carries the two differently dimensioned toothed rims on the same side and whose connecting pieces, which can be inserted in the fan wheel, can be detached, folded back or switched from the outside during the fine, medium-coarse and coarse grinding movements. In this case, the toothed rims, which are connected with the housing so as to be fixed with respect to rotation relative to it, would be axially displaceable, so that either one or the other or neither of them engages with the toothed rims of the intermediate plate. This has the advantage that the different grinding movements can be adjusted from the outside without removing the grinding disk.

It will be understood that each of the elements described above, or two or more together, may also find a useful application in other types of structures differing from the types described above.

While the invention has been illustrated and described as an eccentric grinding machine or grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. In an eccentric grinder comprising a housing, an eccentric shaft, a grinding disk and a device for changing a grinding movement of the grinding disk having at least one fixed friction or toothed rim, the grinding disk being nonrotatably fixed in a central portion thereof to the eccentric shaft and an outer region of the grinding disk being arranged without connection to a remaining group of parts of the grinder and spaced axially therefrom, the improvement comprising at least one exchangeable, intermediate plate, one of said at least one exchangeable intermediate plates having only one other friction or toothed rim on one side thereof and being mountable nonrotatably on said eccentric shaft between the housing and the grinding disk in either of two positions in operation in one of said two positions said other friction or toothed rim engaging said fixed friction or toothed rim while in another of said two positions said other friction or toothed rim being disengaged from said fixed friction or toothed rim so that, when said exchangeable intermediate plate having said one other friction or toothed rim is installed in said position in which said other friction or toothed rim engages in said fixed friction or toothed rim, a rotary motion of the grinding disk occurs in addition to an eccentric motion, but, when said exchangeable intermediate plate having said one other friction or toothed rim is installed in said position in which said other friction or toothed rim is disengaged from said fixed friction or toothed rim, only an eccentric motion of said grinding disk occurs.

2. The improvement as defined in claim 1, wherein said eccentric shaft has a noncircular cross-sectioned end portion, on which both the one exchangeable intermediate plate arranged between the housing and the grinding disk and the grinding disk are releasably mountable in operation.

3. The improvement as defined in claim 2, wherein each of the at least one intermediate plates has a central opening having a noncircular cross section shaped to fit the noncircular cross-sectioned end portion of the eccentric shaft and a raised ring around the central opening, and the grinding disk is supportable on a central region around the ring of the intermediate plate.

4. The improvement as defined in claim 1, further comprising a fan wheel, the eccentric shaft being rotatably mounted in the fan wheel, and wherein the grinding disk is provided with a plurality of ventilation openings and the intermediate plate arranged between the housing and the grinding disk in operation contacts the eccentric shaft and has a plurality of other ventilation openings through which air can flow from the ventilation openings of the grinding disk to the fan wheel.

5. An eccentric grinder comprising a housing; a fan wheel mounted rotatably in the housing, being rotatably drivable in the housing, and provided with a plurality of recesses; an eccentric shaft mounted rotatably and eccentrically in the fan wheel; a grinding disk nonrotatably fixed in a central portion thereof to the eccentric shaft and an outer region of the grinding disk being arranged without connection to a remaining group of parts of the grinder and spaced axially therefrom, and at least one exchangeable intermediate plate, one of said at least one exchangeable intermediate plates being nonrotatably mounted on said eccentric shaft between the housing and the grinding disk in operation in either of two positions, one side of each of said exchangeable intermediate plates being provided with a raised ring and four connecting pieces extending radially outwardly from the ring engagable in a positive-locking manner in the recesses of the fan wheel to cause a rotary motion of the grinding disk in addition to an eccentric motion when said exchangeable intermediate plate is in the one of said positions in which said one side of said intermediate plate faces the fan wheel; and another side of said intermediate plate being structured so that said intermediate plate is freely rotatable relative to the fan wheel, when said exchangeable intermediate plate is in the other of said two positions in which said other side of said intermediate plate mounted between the housing and the grinding disk in operation faces said fan wheel so as to provide a fine grinding motion due to only an eccentric motion of the grinding disk.

6. An eccentric grinder as defined in claim 5, wherein the at least one intermediate plate is made of metal and, further comprising at least one friction or toothed rims connected with the housing (6), said rims being easily exchangeable and made of plastic.

7. An eccentric grinder as defined in claim 6, wherein said metal is die-cast aluminum.

8. The improvement as defined in claim 1, wherein the at least one intermediate plate is made of metal but the toothed rim on said intermediate plate is made of plastic and the toothed rims connected with the housing (6) are made of metal.

9. The improvement as defined in claim 1, wherein the grinding disk is provided with fourteen ventilation openings, six of said ventilation openings being arranged symmetrically with respect to a circle of a diameter of approximately 80 mm and eight of said ventilation openings being arranged symmetrically with respect to another circle of a diameter of approximately 65 mm.

10. An eccentric grinder comprising a housing having at least one fixed friction or toothed rim for providing one of two grinding motions; a fan wheel mounted rotatably in the housing and being rotatably drivable in the housing; an eccentric shaft mounted rotatably and eccentrically in the fan wheel, a grinding disk nonrotatably fixed in a central portion thereof to the eccentric shaft and an outer region of the grinding disk being arranged without connection to a remaining group of parts of the grinder and spaced axially thereform, and at least one exchangeable, intermediate plate, one of said at least one exchangeable intermediate plates having only one other friction or toothed rim on one side thereof and being nonrotatably mounted on said eccentric shaft between the housing and the grinding disk in operation in either one of two positions so that when said exchangable intermediate plate is installed in one of the two positions said other friction or toothed rim engages said fixed friction or toothed rim provided on said housing so as to cause a rotary motion of the grinding disk in addition to an eccentric motion, and when said exchangeable intermediate plate is installed in another of the two positions said other friction or toothed rim is disengaged from said fixed friction or toothed rim provided on said housing so that said intermediate plate is freely rotatable relative to the fan wheel so as to provide a fine grinding motion due to only an eccentric motion of the grinding disk.

11. An eccentric grinder as defined in claim 10, wherein said eccentric shaft has a noncircular cross-sectioned end portion, on which both the one exchangeable intermediate plate arranged between the housing and the grinding disk and the grinding disk are releasably mountable in operation.

12. An eccentric grinder as defined in claim 11, wherein each of the at least one intermediate plates has a central opening having a noncircular cross section shaped to fit the noncircular cross-sectioned end portion of the eccentric shaft and a raised ring around the central opening, and the grinding disk is supportable on a central region around the ring of the intermediate plate.

* * * * *